US007392843B2

(12) United States Patent
Ortiz et al.

(10) Patent No.: US 7,392,843 B2
(45) Date of Patent: Jul. 1, 2008

(54) METHOD OF TREATING SUBTERRANEAN FORMATIONS TO ENHANCE HYDROCARBON PRODUCTION USING PROPPANTS

(75) Inventors: Isaias Ortiz, Dhahran (SA); Ronnie L. Thomas, Tulsa, OK (US)

(73) Assignee: Saudi Arabian Oil Company, Dhahran (SA)

( * ) Notice: Subject to any disclaimer, the term of this patent is extended or adjusted under 35 U.S.C. 154(b) by 191 days.

(21) Appl. No.: 10/533,531

(22) PCT Filed: Nov. 18, 2003

(86) PCT No.: PCT/US03/37252

§ 371 (c)(1),
(2), (4) Date: Nov. 16, 2005

(87) PCT Pub. No.: WO2004/046495

PCT Pub. Date: Jun. 3, 2004

(65) Prior Publication Data

US 2006/0151169 A1 Jul. 13, 2006

(51) Int. Cl.
*E21B 43/267* (2006.01)

(52) U.S. Cl. ..... 166/280.1; 166/308.1; 166/177.5

(58) Field of Classification Search ..... 166/280.1, 166/308.1, 307, 177.5
See application file for complete search history.

(56) References Cited

U.S. PATENT DOCUMENTS

| | | | | |
|---|---|---|---|---|
| 2,879,847 | A | 3/1959 | Irwin | |
| 3,235,007 | A | 2/1966 | Kern et al. | |
| 3,417,819 | A | 12/1968 | Wyllie | |
| 3,701,383 | A | 10/1972 | Richardson et al. | |
| 3,780,807 | A | 12/1973 | Graham et al. | |
| 3,976,138 | A | 8/1976 | Colpoys, Jr. et al. | |
| 4,029,148 | A | 6/1977 | Emery | |
| 4,157,116 | A | 6/1979 | Coulter | |
| 5,105,886 | A | 4/1992 | Strubhar et al. | 166/280 |
| 6,342,467 | B1 | 1/2002 | Chang et al. | 507/110 |
| 2006/0124309 | A1 * | 6/2006 | Nguyen et al. | 166/308.2 |
| 2007/0012445 | A1 * | 1/2007 | Nguyen et al. | 166/281 |

FOREIGN PATENT DOCUMENTS

| | | |
|---|---|---|
| WO | WO 2004/464953 | 6/2004 |

* cited by examiner

*Primary Examiner*—William P Neuder
(74) *Attorney, Agent, or Firm*—Abelman, Frayne & Schwab

(57) ABSTRACT

A method of enhancing the flow of hydrocarbon fluids from small flow conduits (12) in a subterranean reservoir rock formation (10) that have traditionally not been propped in association with a fracturing treatment of the formation (10), the method including the steps of introducing a first pressurized fluid into the formation at a pressure that is sufficient to expand the pre-existing small flow conduits (12) and introducing into the pressure-expanded small flow conduits (12) a first portion of a relatively small particulate propping agent (16); simultaneously with the fracturing of the formation, or immediately thereafter, introducing a second portion of a relatively small particulate propping agent (16) into expanded pre-existing small flow conduits and into any new small flow conduits that are formed by the fracturing of the formation; and reducing the hydraulic pressure on the formation, whereby the small flow conduits are held open by propping agent particles.

17 Claims, 1 Drawing Sheet

METHOD OF TREATING SUBTERRANEAN FORMATIONS TO ENHANCE HYDROCARBON PRODUCTION USING PROPPANTS

FIELD OF THE INVENTION

The invention relates to the use of propping agents, or proppants, in conjunction with fluid hydraulic and acid fracturing of subterranean formations in hydrocarbon reservoirs to enhance the flow of hydrocarbons to a wellbore in the formation.

BACKGROUND OF THE INVENTION

Hydraulic fracturing is a well stimulation technique which involves injecting a fracturing fluid into the formation at rates and pressures sufficient to rupture the formation or widen compressed potential flow conduits, i.e., fissures, cracks, natural fractures, faults, lineaments and bedding planes. In most formations, the earth stresses are such that a vertical crack or fracture is also formed by the hydraulic fracturing treatment. In certain types of formations, the small flow conduits which exist naturally are widened under the hydraulic fracturing process. Once the artificially created fracture is initiated, continued injection of the fracturing fluid causes the hydraulic fracture to grow in length, height and width. A particulate propping agent suspended in a pressurized carrier fluid is then introduced into the relatively larger fractures to maintain them in a propped condition when the fracture-inducing pressure is subsequently relieved. The type and size(s) of the propping agents have been selected based on their ability to prop open the large fractures created in the formation.

In the fracturing of most formations, it is desirable to optimize the width, length and height of the propped fracture in order to increase fracture conductivity. It is known that the success of the well stimulation is strongly influenced by the geometry of the propped fracture. As the fracture width increases, increased fracture lengths can improve well stimulation.

The width of the fracture is normally obtained by controlling variables, such as fluid viscosity and injection rate to achieve the desired fracture geometry. Although large dynamic widths are frequently obtained, the width of the closed fracture is substantially less than the dynamic width, mainly because of the relatively low concentration of proppant in the carrier fluid. In other words, most of the volume in the carrier fluid is liquid, which leaks off into the formation through small flow conduits leaving the proppant wedged in the larger fractures in the formation walls, but unable to enter the small flow conduits.

The improvement in injectivity or productivity of a well by fracturing the formation depends directly on the retained conductivity of a propped fracture system. A wide variety of different techniques and propping agents have been disclosed in the prior art. The following U.S. patents are illustrative of the prior art methods and materials.

For example, U.S. Pat. No. 2,879,847 discloses geometrical shapes that can be introduced into the proppant-fracture system to improve permeability. Protrusions on the sides of three-dimensional objects, such as spheres or the like serve to increase permeability between the spheres or other shapes.

U.S. Pat. No. 3,235,007 discloses multiple layers of respective proppants including metals, ceramics, plastics, steel shot, aluminum, glass-beads and crushed and rounded walnut shells, peach pits, coconut and pecan shells.

U.S. Pat. No. 3,417,819 discloses the use of glass beads flowed into a fracture system with a high viscosity liquid during fracturing.

U.S. Pat. No. 3,701,383 describes electroless metal plating followed by a proppant displaced into the fracture system.

U.S. Pat. No. 3,780,807 discloses injection of a fluid suspension of coarse particles with fine grains of sand or other material bonded to the outer surfaces to maintain pathways between the particles.

U.S. Pat. No. 3,976,138 discloses injection of an alumina propping agent of at least 30 mesh size introduced into a fracture system in a multi-layer distribution scheme.

U.S. Pat. No. 4,029,148 utilizes color-coded proppant that are particles injected at different depths so that the source of the proppant particles can be determined in the event that they backflow and are recovered during later production.

U.S. Pat. No. 4,157,116 discloses the use of material injected to plug a zone around a wellbore in a subterranean formation.

An analysis of the teachings of the prior art technical and patent literature reveals that the methods of formation stimulation have been directed to maintaining flow passageways between particles for retaining permeability, while at the same time maintaining particle contact for retaining high structural strength for propping the fracture open. This approach tends to allow closure over time of production or injection of fluid because of the small movement of the particles with a resultant infusion of particle edges and the like into the passageways to restrict permeability. Moreover, these various types of particles and methods have been resistant to creating the desirable layering in a fully packed propping system in a fracture. Further, these methods have tended to fail in deeper formations where the pressures tending to close a fracture were even greater.

It is known that the flow capacity of certain high compressive strength, deep, over-pressured reservoirs varies with net confining pressure. This net confining pressure is the result of the difference in the overburden pressure and the reservoir pore pressure. As this reservoir pressure is decreased with hydrocarbon depletion, the net confining pressure increases, reducing flow capacity in the matrix and also in small flow conduits.

Many deep, high temperature, low permeability, high compressive stress or over-pressured carbonate and sandstone subterranean formations bearing hydrocarbons contain small flow conduits in the form of, e.g., natural fissures, cracks, natural fractures, lineaments, bedding planes and faults. Productivity from such subterranean formations is determined in large measure by the contribution of hydrocarbons passing through these small flow conduits and into the wellbore. However, the fluid loss (leakoff) that occurs during hydraulic stimulation of these subterranean formations is also increased due to the presence of these small flow conduits.

Although the importance of fracture width has long been recognized by those working in the art, propped widths larger than about 0.3 inches are normally not achieved in deep reservoirs. The contribution of the naturally occurring small flow conduits has been ignored by the prior art fracturing methods, and this despite the recognition of the contribution of such small flow conduits to fluid loss by leakoff during fracturing.

Proppants are of three types: sand, resin coated sand and ceramic proppants. Propping agents, or proppants, include naturally occurring sand, man-made intermediate ceramics, high-strength ceramics, sintered bauxite and resin coated (deformable) sand.

Intermediate strength proppants are defined by reference to the operating conditions into which the proppants will be introduced, i.e., intermediate stresses and temperatures. For example, an ISP will be selected for use at closure stress that is between 4,000 and 8,000 psi and at a bottom hole static temperature of up to 375° F.

High strength proppants would include sintered bauxite. Sintered bauxite, a type of ceramic proppant with a high alumina content, low silica and low clay content, is the strongest proppant available and is used at the greatest depths.

The use of intermediate strength proppants (ISP) and high strength proppants (HSP) have proven effective in enhancing hydrocarbon flow through the induced hydraulic fracture. Conventional fracturing of subterranean formations utilizing quartz sand or other propping agents is ineffective in the small flow conduits of these high compressive stress formations.

Accordingly, it is the object of this invention to provide a method of propping small flow conduits that obviates the disadvantages of the prior art and provides a natural flow system that resists collapse and closure and that retains permeability through a novel mechanism not heretofore employed.

Another object of the invention is to provide an improved propping method for use in deep, high compression formations that will substantially improve hydrocarbon production.

Yet another object of the invention is to provide a novel propping method that can be used advantageously with both acid fracturing and hydraulic fracturing techniques in various types of reservoir rock formations.

SUMMARY OF THE INVENTION

The above objects and other advantages are achieved by the method of the invention which comprises the steps of:

a. injecting a first pressurized fluid into a hydrocarbon bearing subterranean formation from a wellbore at a pressure that is sufficient to expand pre-existing small flow conduits (SFC) to introduce a relatively small diameter particulate propping agent into said expanded small flow conduits;
b. introducing a first portion of a relatively small diameter particulate propping agent into the expanded small flow conduits;
c. injecting a second pressurized fluid into the subterranean formation at a pressure that is sufficient to hydraulically fracture the formation; and
d. maintaining the pressure of the second pressurized fracturing fluid in the formation.

As broadly contemplated, the method of the invention contemplates an overall improvement of results associated with the hydraulic or acid fracturing of reservoir rock formations to improve hydrocarbon production into the wellbore where a main propping agent having a relatively large diameter is utilized to prop the main fractures, the improvement comprising utilizing relatively small propping agent particles to prop small flow conduits. Specifically, the method comprises the steps of:

a. introducing fluid into the formation surrounding the wellbore at a pressure that is great enough to expand pre-existing small flow conduits in the formation;
b. introducing a relatively small particulate propping agent into the small flow conduits while they are maintained in the expanded condition by the first pressurized fluid; and
c. reducing the fluid pressure, whereby the small fluid conduits are maintained in a propped condition.

From the above descriptions, it will be understood that the invention is directed to treating a subterranean formation around a wellbore or the like, in which the naturally-occurring small flow conduits are first expanded and then propped by introducing relatively small particles of intermediate strength and high strength propping agents such as bauxite, into the pressurized small flow conduits system. The propping agents are added to fluid systems when sandstone or carbonate formations are treated to prevent induced fractures (or "small flow conduits") from closing completely after pressure is released at the end of a job.

As used herein, the term "pad" will be understood to refer to a viscous fracturing fluid without proppants that is pumped to generate dynamic fracture width and length, and to prepare fractures for subsequent proppant-laden fluid stages. Higher viscosity fluids reduce fluid leakoff to formations. Pad volumes should be sufficient to avoid 100% leakoff before total fracture length and width have been generated and the proppant has been placed. The possibility of premature pumping treatment screenout can be reduced by increasing injection rate, pad volume or fluid system efficiency. Pad volume is usually reported as a percentage of total viscous fracturing liquid, i.e., the combination of pad and proppant-laden stages.

BRIEF DESCRIPTION OF THE DRAWINGS

The invention will be further described in detail below and with reference to the drawings in which.

DETAILED DESCRIPTION OF THE INVENTION

Figure 1:
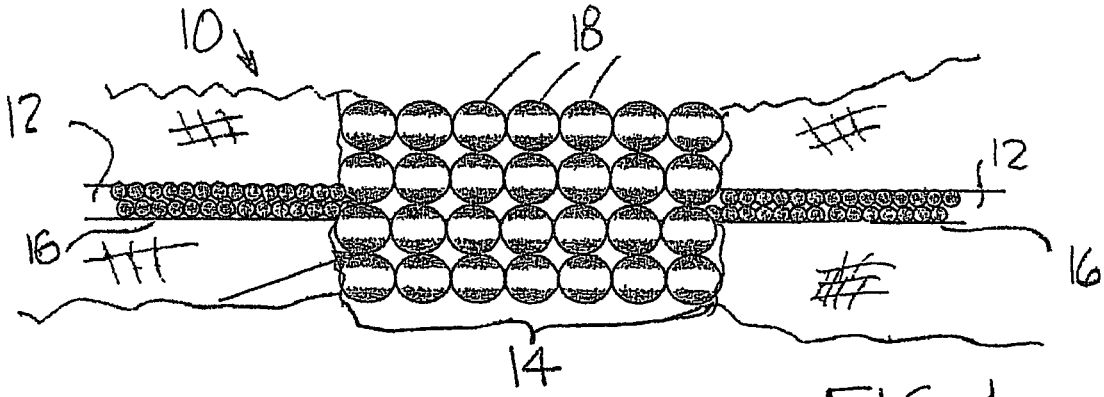
FIG. 1 is a schematic illustration of a portion of a subterranean formation illustrating propping of small fluid conduits in accordance with the present invention.

Referring to the schematic illustration of FIG. 1, a portion of a formation 10, e.g., sandstone reservoir rock, contains a plurality of small fluid conduits 12 that intersect a larger hydraulically induced fracture 14.

As illustrated in FIG. 1, the small fluid conduits have been propped with closely packed and relatively small propping agents 16 and the larger fracture 14 has been propped with much larger main propping agents 18. As will be understood from this schematic illustration, the main propping agents used with the hydraulic fracturing fluid are of diameters or particle sizes that are much too large to enter the small fluid conduits, even when said conduits have been expanded against the stress and compressive forces of the partially depleted formation.

As will also be understood by those of ordinary skill in the art, during the fracturing stage, the larger main propping agents are not so tightly packed into the confines of the fractured channel 14, and the smaller particles of propping agent 16 are able to flow through, around and/or otherwise by-pass any larger particles 18 that may be in the proximity of small flow conduit openings into the fracture channel 14.

In the preferred embodiment illustrated the smaller proppant particles 16 are not able to flow back through the main proppant particles 18 once the fluid pressure is reduced and the compressive forces on the formation are placed on the fractures.

Figure 2:
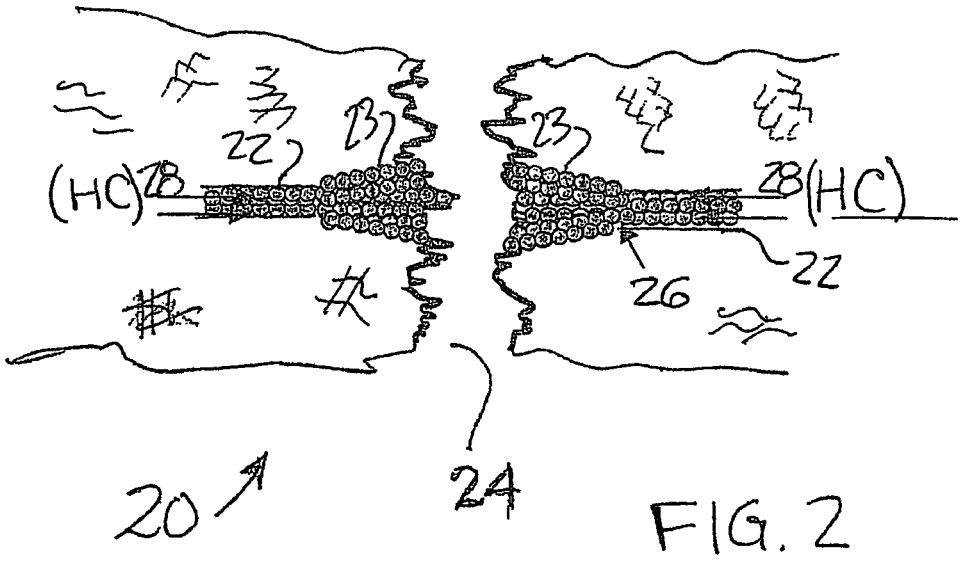
FIG. 2 is a schematic illustration of a portion of a subterranean formation that has been subjected to acid fracturing and propping of small fluid conduits in accordance with another embodiment of the method of the invention.

Referring now to FIG. 2, there is schematically illustrated a portion of a carbonate formation that has been treated with an acid fracturing composition. An acidic fluid composition containing, e.g., hydrochloric acid, dissolves portions of the carbonate formation to create wormholes 24 in irregular patterns that can extend significant distances from the borehole. As illustrated, the wormholes 24 are intersected by a plurality of small fluid conduits 22 having enlarged portions 23 adjacent the wormhole into which have been introduced particulate propping agents 22. These propping agents are introduced during the application of a pressurized fluid that expands the small flow conduits.

The use of intermediate strength proppants and high strength proppants, e.g., bauxite has proven effective in maintaining flow through the induced hydraulic fracture. Specifically, the method of the invention includes the use of 149-micron diameter and smaller ISP and/or bauxite proppants as a method to reduce fluid loss while conducting a hydraulic fracture of a subterranean formation and also as a proppant of the small flow conduits to maintain the flow capacity under the effects of increased net confining pressure.

The following definitions and explanations provide further examples of the small flow conduits to which the method of the invention is directed:

Joint—A fracture which is relatively planar along which there has been little or no obvious displacement parallel to the plane. In many cases, a slight amount of separation normal to the joint surface has occurred. A series of joints with similar orientation form a joint set. Joints may be open, healed or filled; and surfaces may be striated due to minor movement. Fractures which are parallel to bedding planes are termed bedding joints or bedding plane joints. Those fractures parallel to metamorphic foliation are called foliation joints. These are fractures along with no movement has occurred. All rocks are jointed to some extent and weathering occurs in these joints. They offer pathways for water, any clay infilling offering little resistance to sliding.

Bedding plane separation—A separation along bedding planes after exposure due to stress relief or slaking. surface separating layers of sedimentary rocks and deposits. Each bedding plane marks termination of one deposit and the beginning of another character, such as a surface separating a sandstone bed from an overlying mudstone bed. Rock tends to break or separate, readily along bedding planes.

Random fracture—A fracture which does not belong to a joint set, often with rough, highly irregular and non-planar surfaces along which there has been no obvious displacement. A crack or fault in a rock.

Shear—A structural break where differential movement has occurred along a surface or zone of failure. A shear is characterized by polished surfaces, striations slickened-sides, gouge, breccia, nylonite, or any combination of these. Often direction of movement, amount of displacement and continuity are not known because of limited exposures or observations.

Fault—A shear with significant continuity which can be correlated between observation locations; foundation areas, or regions, or is a segment of a fault or fault zone reported in the literature. the designation of a fault or fault zone is a site-specific determination. fault—The surface of rock rupture along which there has been differential movement of the rock on either side.

Shear/fault zone—A band of parallel or subparallel fault or shear planes. The zone may consist of gouge, breccia, or many fault or shear planes with fractured and crushed rock between the shears or faults, or any combination. In the literature, many fault zones are simply referred to as faults.

Shear/fault gouge—Pulverized (silty, clayey, or clay-size) material derived from crushing or grinding of rock by shearing, or the subsequent decomposition or alteration. Gouge may be soft, uncemented, indurated (hard), cemented, or mineralized.

Shear/fault breccia—Cemented or uncemented, predominantly angular (may be platy, rounded, or contorted) and commonly slikensided rock fragment resulting from the crushing or shattering of geologic materials during shear displacement. Breccia may range from sand-size to large bouldersize fragments, usually within a matrix of fault gouge. Breccia may consist solely of mineral grains.

Shear/fault-disturbed zone—An associated zone of fractures and/or folds adjacent to a shear or shear zone where the country rock has been subjected to only minor cataclastic action and may be mineralized. If adjacent to a fault or fault zone, the term is fault-disturbed zone. Occurrence, orientation, and areal extent of these zones depend upon depth of burial (pressure and temperature) during shearing, brittleness of materials, and the inplace stresses.

The term "fissure" refers to a long narrow opening, e.g., a crack or cleft. A "lineament" is a distinctive shape, contour or line.

The method of the invention is utilized in association with well-established practices for the hydraulic and acid fracturing of high temperature, low permeability, high compressive stress, over-pressured carbonate and sandstone subterranean formations where small flow conduits, i.e., natural fissures, cracks, natural fractures, lineaments, bedding planes and faults, are present in the formation surrounding oil/gas wells and similar boreholes.

Small flow conduits remain conductive during the life of the well due to the small size intermediate and high strength proppants placed in them during the hydraulic fracturing treatment. This results in higher sustained production minimizing a rapid production decline due to fissure closure.

This novel technology involves the use of 149-micron diameter and smaller ISP and HSP proppant particles in conjunction with application of a pressurized fluid as a method of reducing fluid loss while conducting a hydraulic fracture of a subterranean formation and also as a proppant of the small conduits to maintain the flow capacity during increased net confining pressure.

Typically, in fracturing a subterranean formation penetrated by a wellbore, a formation packer is located and set into the well on the tubing to isolate and confine a selected producing zone to be fractured. Fracturing fluid is usually a low-penetrating fluid, such as a viscous liquid that can entrain and carry the proppant particles, as well as have an increased hydraulic pressure for fracturing the formation without injection of unduly large amounts of fluid into the formation. Frequently, suspensions are employed to form a filter cake on the face of the formation. The pressure and flow are increased until the formation breakdown is achieved and the fractures are propagated outwardly a desired distance into the formation.

The proppants or particles of propping agents, are introduced into the pressurized fracture and the small flow conduit system to maintain the fractures open after the hydraulic fracturing pressure is reduced.

The particles of propping agent used herein can be of any shape, and are preferably of high to intermediate strength and of less than 149 microns. For example, spherical, ellipsoidal, rectilinear, hexagonal, octagonal, cylindrical, prismatic or any other shape can be used so long as they are amendable to the forming of passageways for increased permeability to flow of fluids through the particles, as well as through the interstices around the particles as the fluid flows from the formation in the case of production. When the injection of a fluid is initiated, the fluid will be pumped into the formation and small flow conduits. The use of propping agents having passageways formed therethrough provide for increased permeability.

The particles can be made from any of the high-strength materials that have satisfactory compressive strength and density to prop the small flow conduits open and resist the closing pressure forces in the small flow conduit system and that allow the particles to be introduced and deposited by hydraulic transport. Preferably, the particles will be formed of man-made substances such as silicic material like hard glass, soda-lime-silica particles in the unannealed or untempered state, alumina, aluminosilicate, ceramic, porcelain, steatite and mullite particles.

With the particles of propping agent of this invention, sustained permeability for protracted intervals has been found to persist in the small flow conduit systems into which these particles have been introduced. Moreover, the injected particles have resisted the closure of the fractures as effectively as the larger conventional particles of the prior art.

From the foregoing, it will be understood that this invention achieves the objectives set forth above and not heretofore achieved. Specifically, this invention provides a method and propping agents for propping small flow conduits in which the natural fractures remain propped open to resist closure by the high structural strength of the particulate of propping agent(s), but also retain increased permeability because of the passageways through the particles that allow fluid to flow directly without torturous passageways, and in addition to the usual flow channels around the particles of propping agent.

Particle size distribution is summarized on Table I below. Typical fracturing sands range from 16 to 40 mesh. The 100 mesh size particles are about the equivalent in size to very fine sand.

TABLE I

| Type Particle | Particle Size Micron |
|---|---|
| boulder | >256,000 |
| cobble | 256,000 |
| pebble | 64,000 |
| granule | 4,000 |
| very course sand | 2,000 |
| course sand | 1,000 |
| 20 mesh, frac sand | 840 |
| medium sand | 500 |
| 40 mesh frac sand | 420 |
| fine sand | 250 |
| very fine sand | 125 |
| very course silt | 62.5 |
| course silt | 31.3 |
| medium silt | 15.6 |
| fine silt | 7.8 |
| very fine silt | 3.9 |
| clay | <3.9 |

For convenience, Table II below is provided to show the English and metric system dimensions corresponding to U.S. Mesh sizes.

TABLE II

| US Mesh | Inches | Mms. | Microns |
|---|---|---|---|
| 20 | 0.0330 | 0.8400 | 840.0 |
| 30 | 0.0230 | 0.5900 | 590.0 |
| 40 | 0.0165 | 0.4200 | 420.0 |
| 50 | 0.0117 | 0.3000 | 300.0 |
| 60 | 0.0098 | 0.2500 | 250.0 |

TABLE II-continued

| US Mesh | Inches | Mms. | Microns |
|---|---|---|---|
| 100 | 0.0058 | 0.1490 | 149.0 |
| 140 | 0.0041 | 0.1050 | 105.0 |
| 200 | 0.0029 | 0.0740 | 74.0 |
| 325 | 0.0017 | 0.0440 | 44.0 |
| 400 | 0.0015 | 0.0370 | 37.0 |
| 450 | 0.0013 | 0.0331 | 33.1 |
| 500 | 0.0012 | 0.0298 | 29.8 |
| 600 | 0.0010 | 0.0248 | 24.8 |
| 700 | 0.0008 | 0.0213 | 21.3 |
| 800 | 0.0007 | 0.0186 | 18.6 |
| 1000 | 0.0006 | 0.0149 | 14.9 |

Fluid loss through small flow conduits are of the width of fractures (<0.25 inches) to clay size particles (3.9 microns).

The closure stress on the proppant increases with reservoir depletion. Shown in Table II below, is the stress on the proppant in a small flow conduit at 2,000 psi and 4,000 psi drawdown (columns a and b) for a typical 14,000 ft. well with an original reservoir pressure of 8,000 psi. The closures stress is estimated to be 5,580 psi and 7,580 psi with 2,000 psi and 4,000 psi drawdown and is unsatisfactory at a 4,000 psi drawdown.

For example, in the Khuff carbonate and pre-Khuff sandstone wells, intermediate or high strength propping agents are required to maintain flow. Table III also shows that unpropped conduits will be subjected to a higher closure stress during reservoir depletion and will close so that they are non-conductive of hydrocarbon fluids.

TABLE III

| (a) Reservoir Pressure (psi) | (b) Minimum Horizontal Stress (psi) | (c) Maximum Horizontal Stress (psi) | (d) Closure Pressure (psi) on Proppant in Conduits with 4000 psi Drawdown | (e) Closure Pressure (psi) on Proppant in Conduits with 2000 psi Drawdown |
|---|---|---|---|---|
| 8000 | 10580 | 11580 | 7580 | 5580 |
| 7000 | 10010 | 11010 | 8010 | 6010 |
| 6000 | 9440 | 10440 | 8440 | 6440 |
| 5000 | 8870 | 9870 | 8870 | 6870 |
| 4000 | 8300 | 9300 | 9300 | 7300 |
| 3000 | 7730 | 8730 | | 7730 |
| 2000 | 7160 | 8160 | | 8160 |
| 1000 | 6590 | 7590 | | |

The following examples illustrate the practice of the method of the invention in two different types of subterranean formations in conjunction with hydraulic fracturing and acid fracturing treatments. As will be understood by one of ordinary skill in the art, just as conventional fracturing treatments vary to take into account the specific conditions of temperature, pressure, depth, type of rock and any number of other local geological conditions and circumstances which are know from well logs, fracturing fluids, as well as the propping agents will be determined based upon local conditions. These choices will be apparent to one of ordinary skill in the art from the above description and from the examples that follow.

As will be understood by one of ordinary skill in the art, certain common preliminary steps must be taken in preparation for the subterranean fracturing operation, also referred to as the "frac job" or the "prop frac treatment", whether the formation is of the sandstone or carbonate type. These steps will be briefly described and will be understood to be of the type generally required for each of the three examples that follow.

Initially, additional fluids are prepared for the main prop frac treatment and the customary quality assurance/quality control tests are performed and recorded.

A CV adapter flange is installed and RU TSI wellhead isolation tool are put in place. The RU frac cross and big inch Y fitting and four three-inch high-pressure treatment lines are installed to the wellhead isolation tool.

The frac equipment and lines are pressure tested to 14,000 psig with water (which corresponds to the maximum allowable tubing pressure plus 2000 psi). The annulus pop-off valves are set to 6500 psi.

The TCA is pressurized to 6000 psig with diesel prior to initiation of the pumping of the fracturing fluid with proppant. The 6000 psig is maintained on the TCA during the stimulation job and no water is admitted to the TCA.

The treatment lines are pressurized to equalize pressure across the wellhead isolation tool and then the valve is opened and the treatment fluid is pumped into the wellbore.

The treatment lines are pressurized to equalize pressure across the wellhead isolation tool and then the valve is opened and the treatment fluid is pumped into the wellbore.

Care should be taken not to exceed the maximum allowed surface pumping pressure of 12,000 psig and the bottom hole treating pressure of 18,000 psig at the packer. A plot of pressure versus rate of flow is followed to lower the pressure as may be required during the job.

EXAMPLE I

Hydraulic Fracturing Treatment

A sandstone formation at approximately 12,000 feet is to be stimulated to enhance hydrocarbon production by means of hydraulic fracturing.

Frac volumes and rates may be altered depending upon initial data obtained. The rate in the main frac is designed for 45 BPM, (barrels per minute) but capacity for 50 BPM with a 50% excess should be available for use if needed.

Treatment Schedule

| Stage | Rate BPM | Event | Stage volume (gal) | Prop Conc. (lb/gal) | Prop Stage Mass (lb) |
|---|---|---|---|---|---|
| 1 | 45 | Conditioning Pre-Pad | 5,000 | 0 | 0 |
| 2 | 45 | Pad w/ISP 100 mesh* | 30,000 | 1 | 30,000 |
| 3 | 45 | Pad w/gel | 25,000 | 0 | 0 |
| 3 | 45 | 20/40 ISP w/Gel** | 8,000 | 1 | 8,000 |
| 6 | 45 | 20/40 ISP w/Gel** | 18,000 | 6 | 108,000 |
| 7 | 45 | 20/40 ISP w/Gel** | 20,000 | 7 | 140,000 |
| 8 | 45 | 20/40 ISP w/Gel** | 17,000 | 8 | 136,000 |
| 9 | 45 | 16/20 ISP w/Gel** | 7,500 | 8 | 60,000 |
| 10 | 45 | Flush WF 30 | | | |

*Pad fluid to be traced with radioactive tracer
**20/40 ISP to be traced with radioactive tracer
***16/20 RCP to be traced with radioactive tracer Thereafter, the pumping is discontinued and the fracturing fluids are displaced to the top perforation in the wellbore. Hydrocarbon fluid flow is observed to resume at a substantially increased flow rate as a result of the stimulation treatment.

EXAMPLE II

Acid Fracturing Treatment

A carbonate formation at approximately 10,000 feet is to be stimulated to enhance hydrocarbon production by means of acid fracturing.

Frac volumes and rates may be altered depending upon results of the step rate up and step rate down tests. The rate in the main frac is designed for 40 to 50 BPM in the initial stage and intended to increase to 80 to 100 BPM in the final stages prior to starting the closed fracture acidizing stage. Based on these parameters adequate excess capacity HHP should be provided.

Treatment Schedule

| Stage | Rate BPM | Event | Stage volume (gal) | Prop Conc. (lb/gal) | Prop Stage Mass (lb) |
|---|---|---|---|---|---|
| 1 | 45 | 28% Neat HCL Acid Spearhead | 15,000 | 0 | |
| 2 | 45 | Pad-50# linear gel w/100 mesh ISP* | 30,000 | 1 | 30,000 |
| 3 | 55 | 28% HCL Neat Acid** | 35,000 | 0 | |
| 4 | 65 | Pad-50# linear gel** | 9,450 | 1 | |
| 5 | 75 | 28% HCL Neat Acid** | 21,000 | 2 | |
| 7 | 85 | 28% HCL Carbonate Stimulation Acid (Gelled Acid)** | 16,800 | 4 | |
| 8 | 85/45 | Over flush 40# linear gel* | 30,000 | 6 | |
| 10 | 45/10**** | Flush & OF 40# gel | 30,000 | 7 | |

*Pad fluid to be traced with radioactive tracer
**28% ZCA & CSA to be traced with radioactive tracer
***28% HCL CFA to be traced with radioactive tracer
****Whereby BHP < Closure Thereafter, the pressure is relieved and the pressurizing and acid treating fluids are displaced to the top perforation. Hydrocarbon fluid flow is observed to resume at a substantially increased flow rate as a result of the stimulation treatment.

EXAMPLE III

Acid Fracturing Treatment

With Proppant Tail-In

The carbonate formation of Example II is treated to stimulate production from an adjacent wellbore.

Frac volumes and rates may be altered depending upon results of the step rate up and step rate down tests. The rate in the main frac is designed for 40 to 50 BPM in the initial stage and intended to increase to 80 to 100 BPM in the final stages prior to starting the closed fracture acidizing stage. Based on these parameters, adequate excess capacity HHP should be provided.

Treatment Schedule

| Stage | Rate BPM | Event | Stage volume (gal) | Prop Conc. (lb/gal) | Cum. Vol. (gal) |
|---|---|---|---|---|---|
| 1 | 45 | Cool down, Reactive Spearhead | 20,000 | | 20,000 |
| 2 | 45 | Pad w/gel* | 20,000 | | 40,000 |
| 3 | 55 | 28% HCL** | 30,000 | | 70,000 |
| 4 | 55 | Pad H40# gel* | 20,000 | | 90,000 |
| 5 | 65 | 28% HCL** | 30,000 | | 120,000 |
| 6 | 75 | Pad H40# gel* | 20,000 | | 140,000 |
| 7 | 85 | 28% HCL Carbonate Acid** | 30,000 | | 170,000 |
| 8 | 75/65 | Over flush 40# linear gel* | 30,000 | | 200,000 |
| 9 | 65/45 | 28% HCL CFA*** | 10,000 | | 210,000 |
| 10 | 20/10**** | Flush & OF 40# w/ISP 100 mesh | 30,000 | 30,000 | 240,000 |

*Pad fluid to be traced with radioactive tracer
**28% ZCA & CSA to be traced with radioactive tracer
***28% HCL CFA to be traced with radioactive tracer When the well is put back into production, the rate of hydrocarbon flow is observed to have been increased substantially over the pretreatment flow rate.

The above examples are illustrative of the improved method for treating typical sandstone and carbonate formations. As will be apparent to one of ordinary skill in the art, variations in the steps can be made without departing from the essential purpose and function of the method of expanding existing small flow conduits and introducing appropriate propping agents into the expanded conduit prior to relieving the pressure on the expansion fluid.

For example, the relatively small flow conduit propping agents can be introduced with a pressurizing fluid as described above in advance of the fracturing fluid. In a second preferred embodiment, the conduit propping agents can be introduced with the fracturing fluid, either alone or in combination with the larger propping agents that are designed to maintain in an open position the much larger and new fractures in the formation.

In yet another preferred embodiment, the smaller conduit propping agents can be introduced into the formation after the major fracturing fluid has performed its functions. In the latter case, the smaller propping agents can pass through, around and/or otherwise by-pass the larger propping agent particles in order to gain access to the small fluid conduits while the conduits are in the expanded state. Once the pressure has been relieved, of course, the compressive forces on the formation will result in a tighter packing of the main propping agents in the much larger fractures and the proppants in the small flow conduits will be compressed.

From the above description, it will also be understood that the interstitial spaces between the main propping agent particles will, in most cases, prohibit the backflow of the smaller propping agent particles when formation compressive forces are restored and subsequently during hydrocarbon production.

The method of the invention is also directed generally to improvements in the hydraulic fracturing of hydrocarbon-bearing subterranean formations. The invention comprehends methods for controlling fluid leakoff through small flow conduits in the formation during the fracturing procedures. During a hydraulic fracturing treatment of a subterranean formation penetrated by a wellbore, adverse vertical height growth of the induced fracture is controlled by the improvement comprising injecting a non-proppant fluid phase. The non-proppant fluid phase comprises a transport fluid and a flow blocking material of a particle size distribution sufficient to form a substantially impermeable blockage to fluid flow in the small flow conduits system in a vertical direction.

In one aspect, the invention comprises first injecting into the formation a fluid pad at a sufficient rate and pressure to create a fracture in the formation. The pad is followed by injecting the small mesh size particulate propping material fluid stage to control vertical fracture height growth into the small flow conduits system. This fluid phase will not serve to prop large fractures or wormholes. However, once introduced into the small flow conduits, this phase will serve as a proppant of the small flow conduits in the formation when the fracturing fluid pressure is subsequently reduced.

From the above description and examples, it will be understood that still further modifications to the process will be apparent to those of ordinary skill in the art and the scope of the invention is therefore to be determined with reference to the claims that follow.

We claim:

1. A method for the fracturing of a subterranean hydrocarbon bearing formation to stimulate the production of said hydrocarbons, the method comprising the steps of:

a. injecting a first pressurized fluid into the subterranean formation from a wellbore passing through the formation at a pressure that is sufficient to expand pre-existing small flow conduits to permit introduction of a particulate propping agent into said expanded small flow conduits;

b. introducing a first portion of a first particulate propping agent into the expanded small flow conduits;

c. injecting a second pressurized fluid into the subterranean formation at a pressure that is sufficient to hydraulically fracture the formation; and d. maintaining the pressure of the second pressurized fracturing fluid in the formation.

2. The method of claim 1, wherein a proppant pack is formed in the small flow conduits by the particulate propping agent.

3. The method of claim 1, wherein the particulate propping agent is selected from the group consisting of intermediate compressive strength materials, high compressive strength materials, and combinations thereof.

4. The method of claim 1, wherein the size of the particulate propping agent is about 149 microns.

5. The method of claim 1, wherein the size of the first particulate propping agent introduced into the small fluid conduits is greater than the interstitial spaces formed by larger propping agents in the fracture openings, whereby backflow of the first particulate propping agent particles into the propped fracture openings is prevented.

6. The method of claim 1, wherein the first particulate propping agent is resin coated.

7. The method of claim 1, wherein the first particulate propping agent includes an additive selected from the group consisting of flowback prevention additives, fibers, deformable materials, and combinations thereof.

8. In the method of enhancing the flow of hydrocarbon fluids from a subterranean reservoir rock formation in association with a fracturing treatment of the formation, the improvement comprising:

a. in conjunction with fracturing the formation, introducing a first pressurized fluid into the formation at a first pressure that is sufficient to expand pre-existing small flow conduits;

b. introducing into the pressure-expanded small flow conduits a first portion of a particulate propping agent;

c. simultaneously with the fracturing of the formation, or immediately thereafter, introducing a second portion of a particulate propping agent into formed pre-existing small flow conduits and into any new small flow conduits that are expanded by the fracturing of the formation; and d. reducing the hydraulic pressure on the formation, whereby the small flow conduits are held open by the propping agent particles.

9. The method of claim 8, wherein the fracturing treatment is a hydraulic fracturing treatment.

10. The method of claim 8, wherein the fracturing treatment is an acid fracturing treatment.

11. The method of claim 8, wherein the first and second portions of particulate propping agent are the same material.

12. The method of claim 8, wherein the size of the first and second portions of particulate propping agent are about 149 microns and smaller.

13. The method of claim 8, wherein a proppant pack is formed in the small flow conduits by the particulate propping agent.

14. The method of claim 8, wherein the particulate propping agent is selected from the group consisting of intermediate compressive strength materials, high compressive strength materials, and combinations thereof.

15. The method of claim 8, wherein the first particulate propping agent is resin coated.

16. The method of claim 8, wherein the second portion of particulate propping agent is mixed with a hydraulic fracturing fluid composition of guar and VES fluids to form a slurry.

17. The method of claim 8, wherein the second portion of particulate propping agent is introduced into the formation simultaneously with the fracturing fluid slurry containing the main fracture proppant materials.

* * * * *